US012311233B2

(12) United States Patent
Rico Arenal et al.

(10) Patent No.: US 12,311,233 B2
(45) Date of Patent: May 27, 2025

(54) THREADED ANCHOR FOR ICE CLIMBING

(71) Applicant: INGECID, INVESTIGACIÓN Y DESARROLLO DE PROYECTOS, S.L., Santander (ES)

(72) Inventors: Jokin Rico Arenal, Santander (ES); Cesar González Galván, Santander (ES)

(73) Assignee: Ingecid, Investigacion Y Desarrollo De Proyectos, S.L., Santander (ES)

( * ) Notice: Subject to any disclaimer, the term of this patent is extended or adjusted under 35 U.S.C. 154(b) by 297 days.

(21) Appl. No.: 18/008,174

(22) PCT Filed: Jun. 2, 2021

(86) PCT No.: PCT/ES2021/070394

§ 371 (c)(1),
(2) Date: Dec. 4, 2022

(87) PCT Pub. No.: WO2021/246310

PCT Pub. Date: Dec. 9, 2021

(65) Prior Publication Data

US 2023/0271061 A1 Aug. 31, 2023

(30) Foreign Application Priority Data

Jun. 4, 2020 (ES) ..... 202030532

(51) Int. Cl.
*A47F 5/08* (2006.01)
*A63B 29/02* (2006.01)

(52) U.S. Cl.
CPC ..... *A63B 29/025* (2013.01)

(58) Field of Classification Search
CPC ..... A63B 29/025; A63B 29/02
See application file for complete search history.

(56) References Cited

U.S. PATENT DOCUMENTS 5,782,442 A 7/1998 Kwak et al.
6,068,226 A * 5/2000 Anders ..... A63B 29/025 248/231.91

(Continued)

FOREIGN PATENT DOCUMENTS

CN 102961856 A 3/2013
DE 102010021102 A1 11/2011

(Continued)

*Primary Examiner* — Amy J. Sterling
(74) *Attorney, Agent, or Firm* — Timur E. Slonim, Esq.; LAW OFFICE OF TIMUR E. SLONIM, ESQ.

(57) ABSTRACT

A threaded anchor for ice climbing, comprising: —a screw with a cylindrical tubular body, a number of cutting teeth, a rearward perimetric protruding threaded section; —a clamp disposed exteriorly with regard to the screw and comprising an operating component, displaceable between: a locked position, where the tightening of the clamp and the fixing thereof at any point along the length of the screw is established, and an unlocked position, enabling the turning of the clamp with regard to the screw and the positioning of the clamp at any point along the length of said screw; —a folded strap attached by its first end to the clamp and presenting at its second end a closed loop for the mounting of a carabiner suited for the hitching of the climbing rope in its position of use or of a harness of the climber in an inoperative position.

8 Claims, 8 Drawing Sheets

(56) References Cited

U.S. PATENT DOCUMENTS

| | | | | |
|---|---|---|---|---|
| 6,607,340 | B2 * | 8/2003 | Petzl | A63B 29/025 248/231.9 |
| 7,347,403 | B2 * | 3/2008 | Belcourt | A63B 29/027 248/231.9 |
| 9,303,456 | B1 * | 4/2016 | Fiorello | A63B 29/025 |
| 9,555,287 | B2 * | 1/2017 | Fiorello | E21B 7/008 |
| 2013/0136561 | A1 | 5/2013 | Maurice et al. | |

FOREIGN PATENT DOCUMENTS

| | | | |
|---|---|---|---|
| EP | 1491238 | A2 | 12/2004 |
| EP | 2719428 | A1 | 4/2014 |
| ES | 1126906 | U | 10/2014 |
| FR | 2881056 | A1 | 7/2006 |
| FR | 2971947 | A1 | 8/2012 |
| RU | 2051719 | C1 | 1/1996 |

* cited by examiner

THREADED ANCHOR FOR ICE CLIMBING

TECHNICAL FIELD

The present invention relates to a threaded anchor for ice climbing, applicable in the field of climbing anchors and, in particular, for ice climbing.

BACKGROUND ART

Currently, anchors for ice climbing are widely known, comprising: a screw with a cylindrical tubular body having ice cutting and penetrating teeth at its leading end; at least one threaded leading section on its external surface; a stop perimeter projection at its rear end; and means for attaching the climbing rope to the said screw.

These anchors have different characteristics both in terms of the means of hitching the climbing rope to the screw, and the means used to rotate the screw during its screwing or unscrewing in the ice. A known type of anchor, such as that described in patent US 20130136561, comprises, at one end, a perforated plate with two holes, in one of them the screw is arranged, and the other is to clip a carabiner where the climber's rope is fitted; at one end of the plate there is a tab acting as a crank in the function of screwing and unscrewing the screw in the ice.

Patent CN 102961856 describes an elongated plate with two holes, one in the middle of the plate to fit the screw; in the other hole, which is arranged at one of the ends of the plate, there is the carabiner; and at the other end a crank is fitted perpendicular to the plate, for the rotation of the screw for quickly screwing it in and unscrewing it from the ice.

In patent FR 2 881 056, the crank fitted on the plate is foldable by means of a shaft and wire arms.

In U.S. Pat. No. 5,782,442, the crank fitted on the plate consists of a folding arm that folds over the plate, arranged vertically with respect to the flat head of the screw.

One problem with these anchors is that the plate must be positioned on the head of the screw without possibility of rotation to transmit the rotation of the crank to the screw, so once the screw is inserted into the ice, and the carabiner is fitted, the screw cannot be oriented or its orientation is limited. In addition, this structure is not elastic, but rigid with respect to the torsions or movements that the climbing rope, which is arranged in a hole of the plate of the end of the screw, may experience; these torsions or movements, may cause the loosening of the fixing of the screw or the breakage of the ice where it is screwed.

To reduce the rigidity of this system and avoid the transmission of torsions to the screw screwed in the ice, it is necessary to incorporate a "quick strap", which is a strap with a carabiner at each end. In this way, once the screw has been screwed into the ice, the first carabiner of the "quick strap" is placed in a hole in the plate, and in the second carabiner, arranged at the other end of the "quick strap", the climber's rope is hitched. This arrangement avoids the rigidity of the system, but this implies carrying additional equipment: the ice screws and the "quick straps".

To try to solve the aforementioned problem of rigidity without having to place the "quick straps", a solution used, as described in patent EP 1 491 238, is an anchor comprising a strap fitted at one of its ends on a washer that rotates on the screw, a carabiner being placed at the other end of the strap. This configuration acts as a "quick strap"; unlike the previous system, where the carabiner had to be fitted once the screw had been screwed, in this system the carabiner is incorporated into the strap. In addition, a crank is arranged on the screw head, which can be folded down, and is deployed in the screw screwing and unscrewing functions.

Although it is foldable, the incorporation of the crank in the screw has the disadvantage that it takes up a lot of space, especially considering that the climber must carry screws of various lengths in their belt, for different thicknesses of the ice.

Another drawback of the known anchors for ice climbing, is that the user has to carry screws of different lengths to place one or the other depending on the thickness of the ice and thus prevent part of the screw shaft from protruding from the ice, which will cause the lever effect that occurs when applying the load on the end of the screw, with the breakage or loosening of the ice where the screw is screwed. When the climber has inserted a screw that protrudes excessively from the ice, they have to take a strap, tie a lark's head knot on the shaft of the screw and approach it to the ice wall, but this is a complicated solution to perform with one hand and wearing gloves.

An additional problem, derived from the climber's need to carry screws of different lengths, is that these are fitted on the climber's belt harness hooked in the holes of the screw plate, one on top of the other, so to take a screw of a certain length it is necessary to previously remove all the screws of another length that are on it. This operation at height, holding with one hand the ice axe embedded in the ice and using the only free hand, and wearing gloves, is also especially uncomfortable and generates a stressful situation.

The anchor of patent EP 2 719 428 shows a screw with a cylindrical head to allow its screwing function, and with a strap fitted on a washer that rotates on the screw, a carabiner being fitted on the other end of the belt. The strap has a clip that is tightened on the screw to securely position the strap parallel to the screw. With this arrangement, this anchor can be hitched to the climber's belt, by means of the carabiner that has an opening and closing trigger; and the chosen screw can be removed from the climber's belt without having to remove any other. The drawback of this invention is that it does not solve the problem of having to carry several screws of different lengths, for the different thicknesses of ice that the climber may find. In addition, the attachment clip is rigid and takes up considerable volume in the climber's belt along with the other screws.

SUMMARY OF THE INVENTION

To solve the aforementioned drawbacks, an anchor for ice climbing has been devised in this invention comprising: a cylindrical tubular body having ice cutting and penetrating teeth at its leading end, at least one threaded leading section on its external surface, and a stop perimeter projection at its rear end.

To solve the aforementioned drawbacks, the anchor of this invention also comprises:

- a clamp arranged externally with respect to the screw and comprising an actuating part movable between: a locking position in which the clamp is tightened and fixed, without possibility of rotation or movement, at any point along the screw; and an unlocking position allowing for the clamp rotation with respect to the screw and the clamp positioning at any point along said screw;
- a folded strap, attached by a first end to the clamp and having at its second end a closed loop for fitting a carabiner suited for the hitching of the climbing rope in a position of use of the anchor, or of a climber's harness or equipment carrier in an inoperative position.

In the locking position, the actuating part locks the clamp relative to the screw, allowing the strap itself to be used as a crank to turn the screw and screw it into or unscrew it from the ice.

In one embodiment of the invention, the strap has on a section of its length, close to the clamp, a coating forming a grip and/or transmission area of a torque to the clamp and to the screw, when said clamp is locked on the screw, without possibility of rotation or longitudinal movement.

Although the strap itself, or the carabiner attached to the second end thereof, can be manually operated to use the strap as a crank, the incorporation of this coating facilitates its grip and the transmission of the turning movement to the screw.

Once the screw has been inserted into the ice, it is sufficient to unlock the clamp by means of the actuating part so that it can move and rotate with respect to the screw, thus releasing stress that could cause the screw to loosen in the ice.

According to the invention, the first end of the strap is attached to the clamp with possibility of rotation about an axis perpendicular to a plane coinciding with a longitudinal axis of the screw body, allowing said strap to be arranged parallel to the screw, taking a minimum space in an inoperative or transport position, or significantly perpendicular to it, for example, during its use as a crank to rotate the screw.

In one embodiment of the invention, a plug is provided, which is fixed to the strap and suitable for covering the teeth of the leading end of the screw. In this way, in an inoperative or transport position of the anchor, the strap with the carabiner is fixedly parallel to the screw. The clamp is moved along the screw to allow the entry and positioning of the plug on the end of the screw.

In one embodiment of the invention, the strap is fitted with its first end on a stem, linked said stem to the actuating part, and responsible for the stem to approximate the opposite ends of the clamp, causing the clamp to lock on the screw when the actuating part is placed in the locking position.

With the aforementioned characteristics, this anchor presents a number of advantages with respect to the state of the art that are enumerated below.

This anchor allows the screw to be screwed into the ice quickly and comfortably for the climber.

It allows to fix the clamp close to the surface of the ice wall, once the screw is inserted into the ice, avoiding the dangerous leverage effect that occurs when an effort is applied on the rear end of the screw, due to a fall or strong traction of the climber, thus minimising the risk of ice breakage in the sitting area of the screw, and of accident of the climber, without the need to use different screw lengths or tie lark's head knots, eliminating a difficult manoeuvre and resulting in the safety of the climber.

Also, derived from the above, it should be noted that the anchor elements that hold the climber provide a non-rigid structure in the movement of the climber's load, so that the weight of the climber does not pull "suddenly" in its tractions or falls on the screw.

Therefore, another advantage of this anchor with respect to some of the patents found is that it avoids placing a "quick strap" on the screw once it has been screwed into the ice, since the screw itself, with the strap and the carabiner, is equivalent to a "quick strap".

Another advantage of the invention is that it does not have an additional crank, but the rotation of the screw is achieved by means of the turns of the clamp locked on it, being sufficient the strap itself to rotate the screw, regardless of whether or not said strap incorporates a coating in the area near the clamp.

The possibility of fixing the clamp at any point along the screw makes it unnecessary for the climber to have to carry screws of various lengths for different ice thicknesses.

Another advantage of the anchor of the invention is that it is hitched to the climber's equipment carrier by means of the corresponding carabiner, which is facilitated by positioning the strap parallel to the screw, by placing the plug on the end of the screw, thus allowing to directly release any of the anchors from the equipment carrier belt, regardless of whether it is below or above other anchors.

BRIEF DESCRIPTION OF THE CONTENTS OF THE DRAWINGS

In order to complement the description that is being carried out and with the purpose of facilitating the understanding of the characteristics of the invention, the present description is accompanied by a set of drawings wherein, by way of a non-limiting example, the following has been represented:

Figure 7:
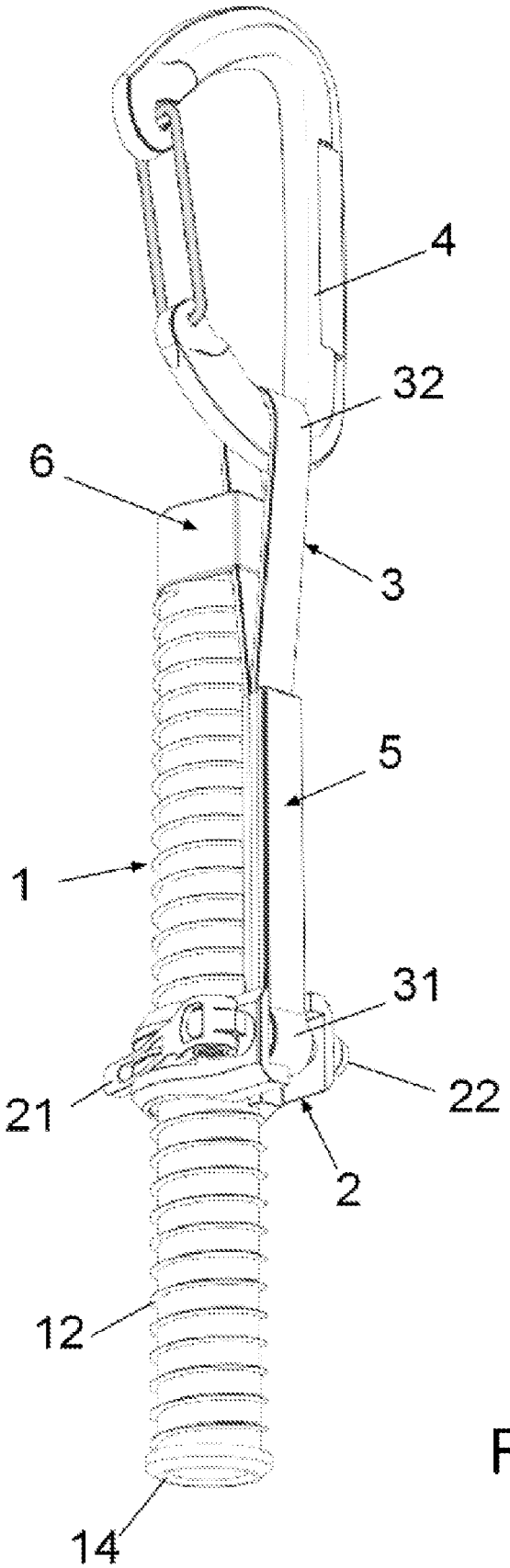
FIG. 7 shows a perspective view of an embodiment of the anchor, in which the screw is provided with an external surface threaded in its entirety and represented in a transport position, in which the teeth are covered by a plug fixed to the strap.
Figure 8:
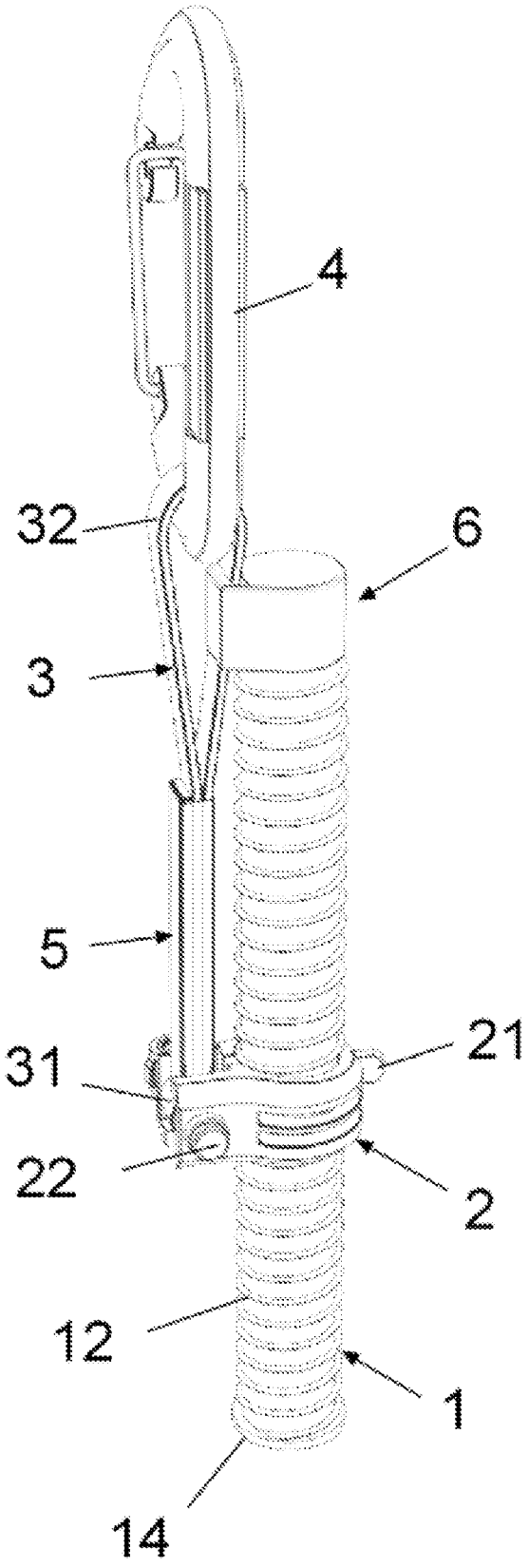

FIG. 8 corresponds to another perspective view of the anchor in FIG. 7.

DETAILED EXPLANATION OF EMBODIMENTS OF THE INVENTION

Figure 1:
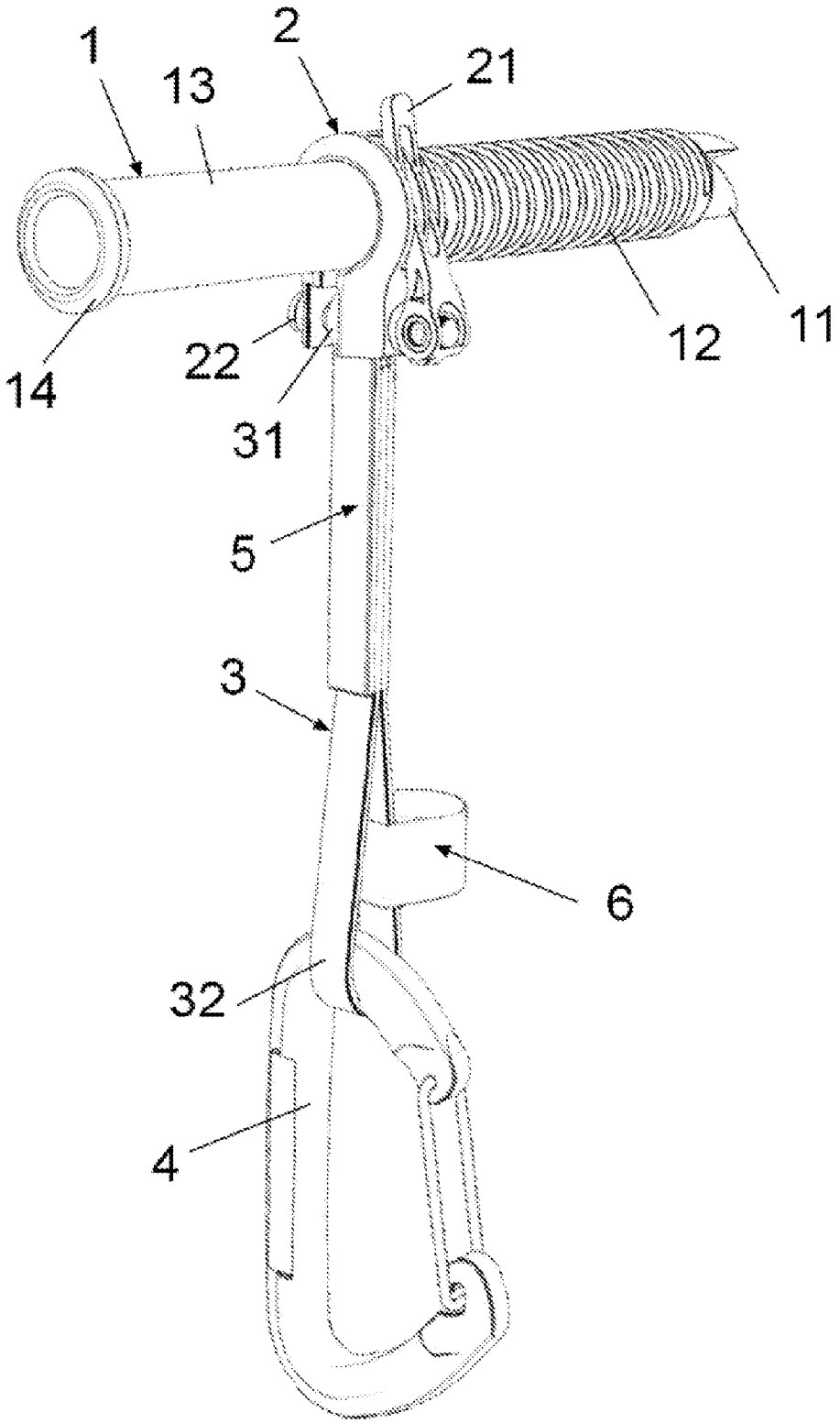
FIG. 1 shows a perspective view of an exemplary embodiment of the anchor for ice climbing according to the invention, the screw having a leading threaded section and a smooth rear section with the clamp locked in an intermediate area of the screw.

In the exemplary embodiment shown in FIG. 1, the anchor for ice climbing comprises a screw (1) itself, provided with a cylindrical tubular body having at its leading end teeth (11); at its outer surface a threaded leading section (12) and a cylindrical rear section (13); and at its rear end a perimeter projection (14); on the screw (1) a clamp (2) is fitted to which a folded strap (3) is attached, carrying a carabiner (4).

Figure 2:
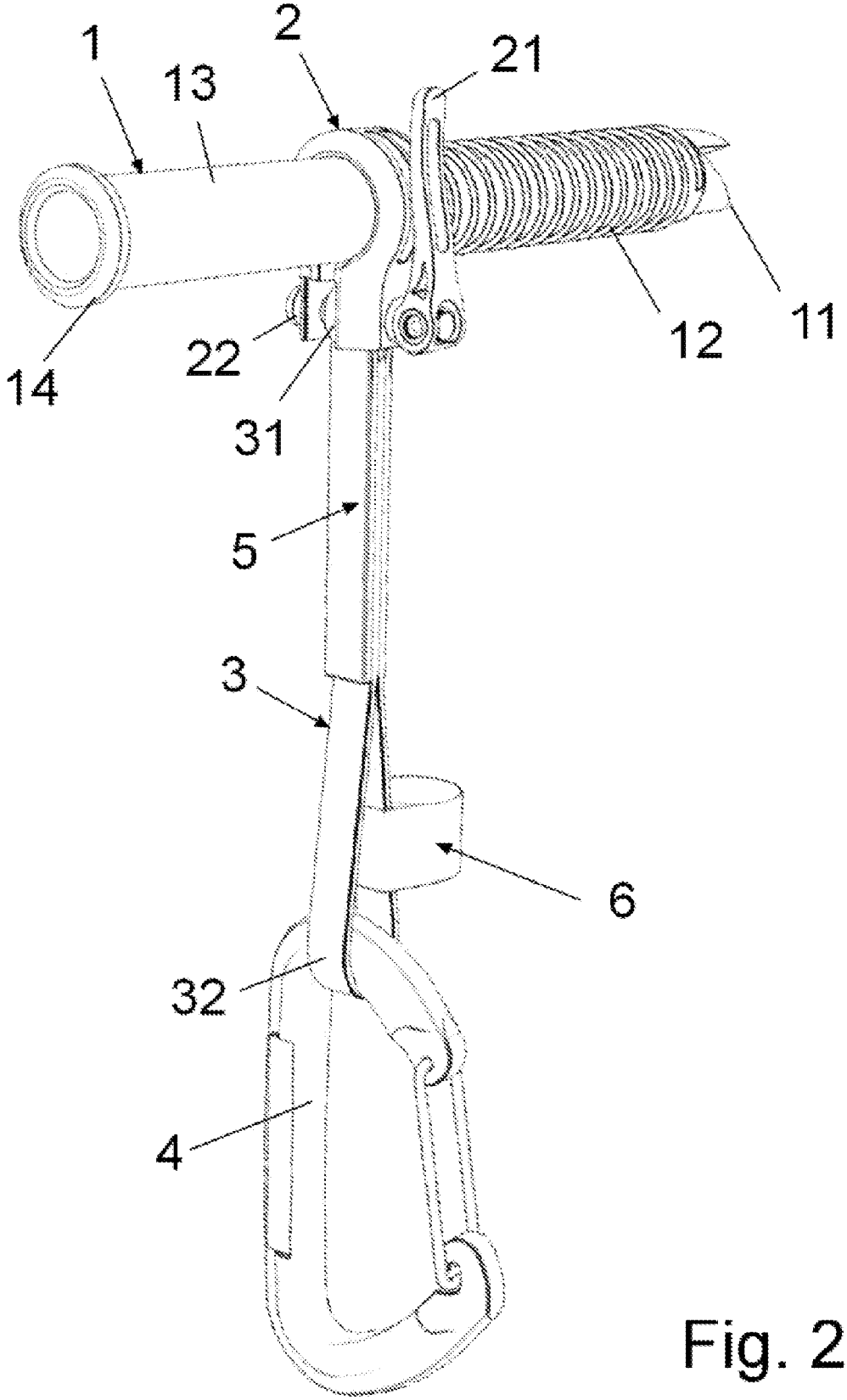
FIG. 2 shows a view analogous to the previous one, with the clamp unlocked.
Figure 3:
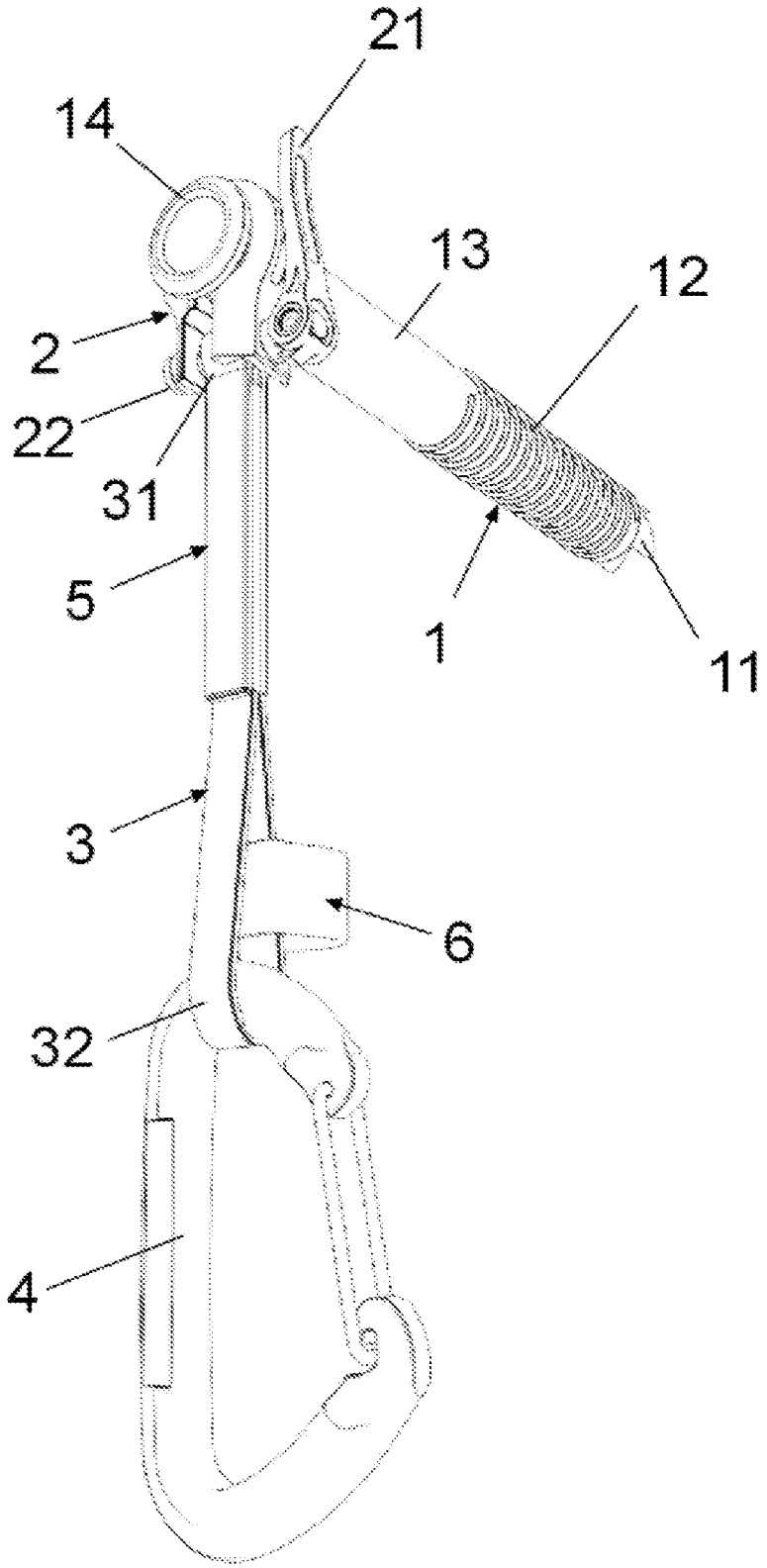
FIG. 3 shows a perspective view of the anchor according to the invention, with the clamp unlocked at the rear end of the screw.
Figure 4:
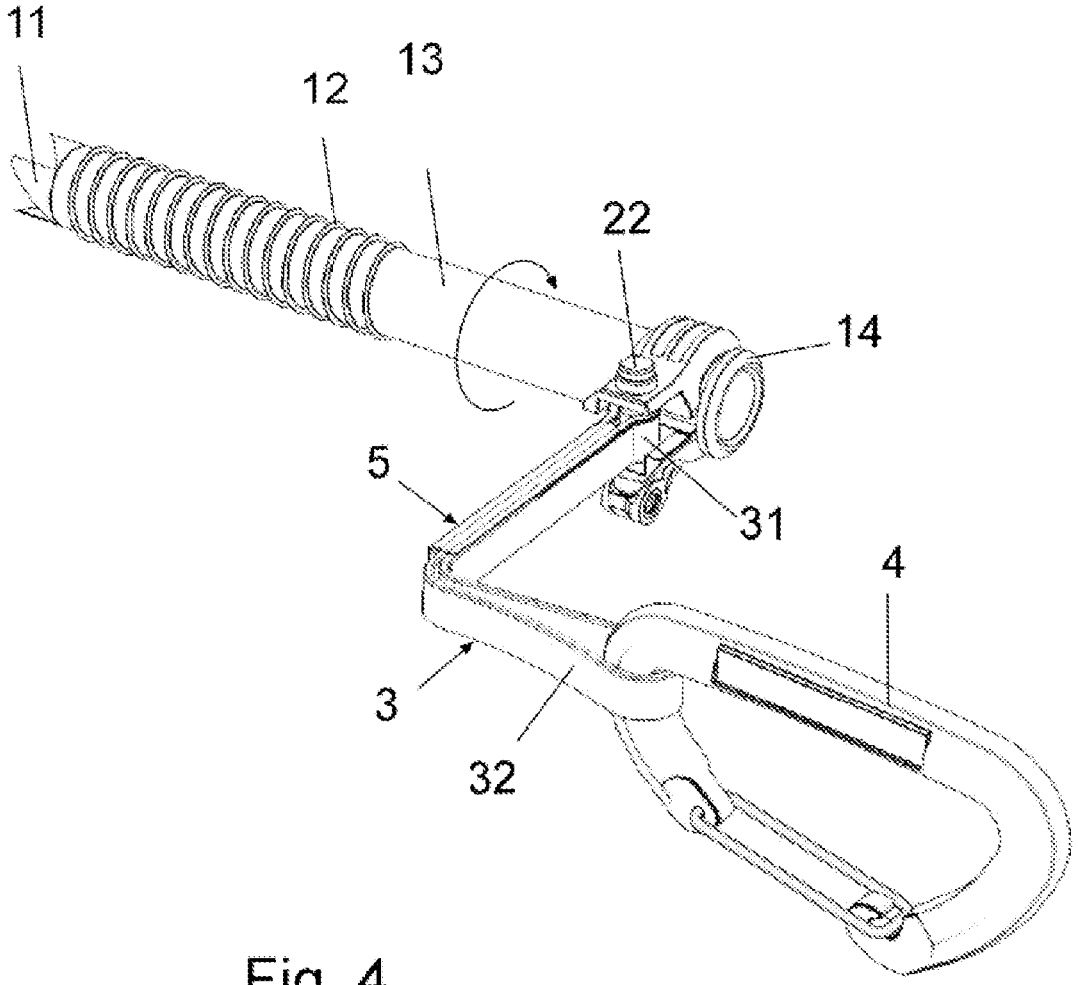
FIG. 4 shows a perspective view of the anchor of the previous figures, with the clamp locked at the rear end of the screw and with the piece of the strap provided with a coating of non-flexible material arranged perpendicularly to the screw and the rest of the strap being folded towards the rear area of the screw.

The clamp (2) is provided with an actuating part (21) acting on a stem (22), and which is able to move between a locking position, shown in FIG. 1, in which the clamp is unable to rotate and to move longitudinally with respect to the screw (1), and an unlocking position, represented in FIG. 2, in which the clamp can rotate freely and move along the screw (1).

The strap (3) is attached by a first end (31) to the clamp (2), specifically to the stem (22), and has a second end (32), in the form of a closed loop, for fitting the carabiner (4). This carabiner (4) allows the hitching of the climbing rope (not shown) when the anchor (1) is in use, and the hanging, by means of the carabiner, of the assembly of the anchor on the climber's equipment carrier when said anchor is not in use.

The clamp (2) can be arranged at any point along the screw (1), both on the threaded area and on the smooth area, so that once the screw (1) is introduced into the ice, said clamp can be locked in a position very close to or in contact with the surface of the ice wall, thus minimising the lever effect and, consequently, the stresses transmitted to the anchoring area of the screw by any force supported by the clamp.

Figure 5:
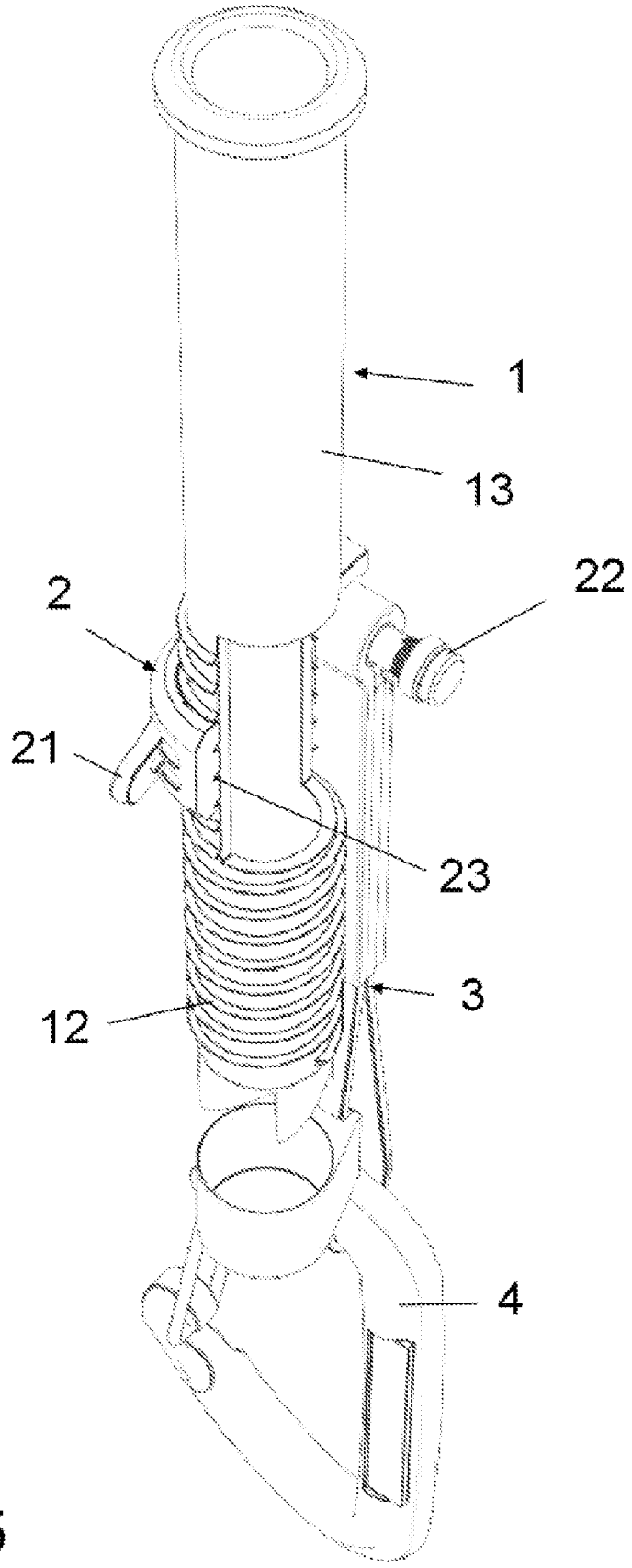
FIG. 5 shows a perspective view of the anchor of the previous figures, in which an intermediate portion of the screw and the clamp has been diametrically sectioned, allowing to see the inner thread of said clamp.
Figure 6:
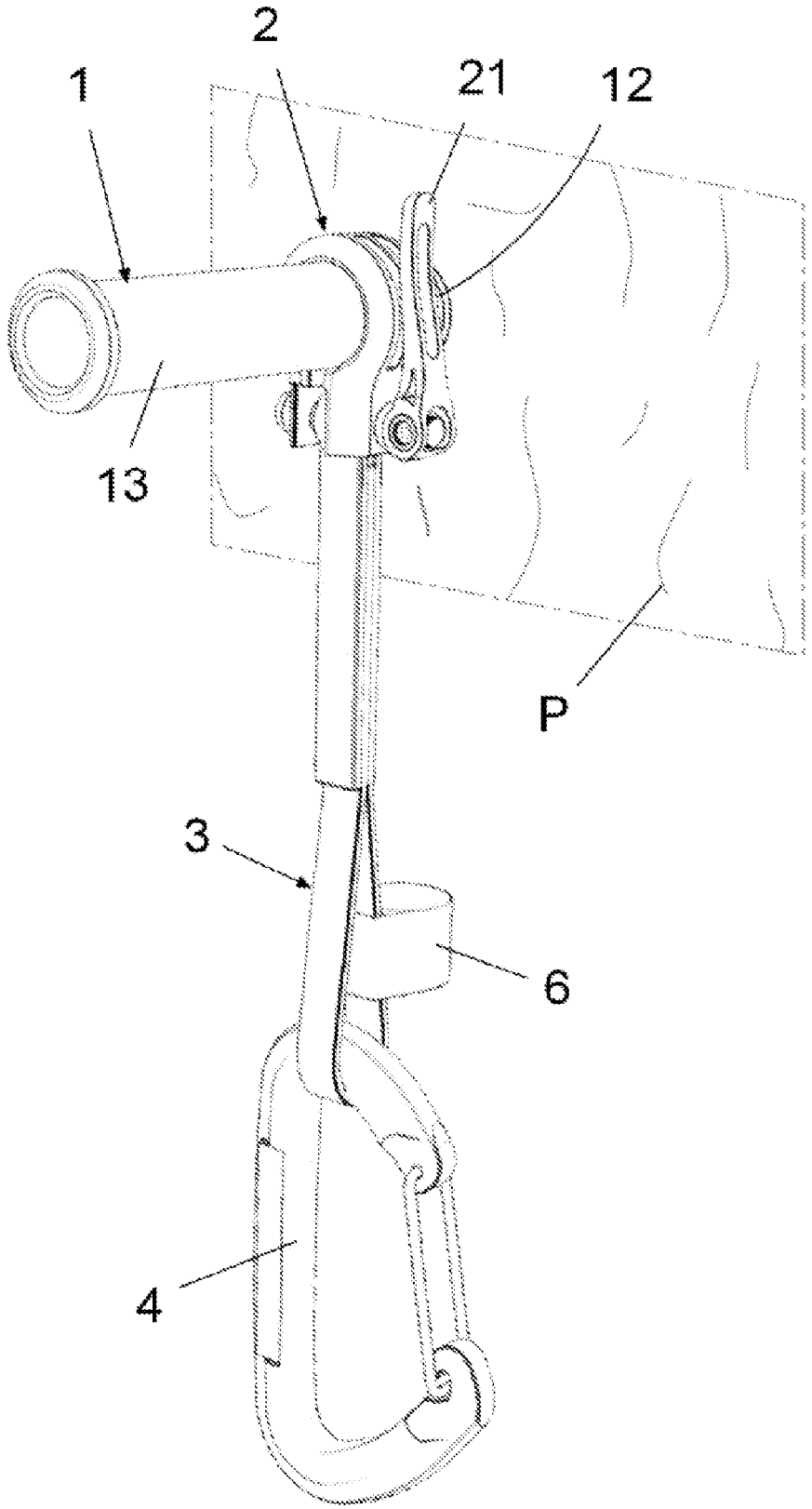
FIG. 6 shows a perspective view of the anchor of the invention, with the screw inserted into an ice wall, and with the clamp in contact with said ice wall.

As can be seen in FIG. 5, the clamp (2) has an internal thread (23) complementary and engageable to the thread of the leading section (12), said threads having a height suitable to allow their contact both in the locking position and in the unlocking position of the clamp; so that in the unlocking position the clamp (2) can rotate on the thread of said threaded leading section (12), forward or backward along the screw (1). This feature allows, on the one hand, that the clamp can approach the surface of an ice wall (P) when a portion of the threaded leading section (12) protrudes from said wall, as shown in FIG. 6, and, on the other hand, that the clamp (2) can be oriented in any radial direction, depending on the stresses transmitted by the climber to the strap (3).

In the locking position of the clamp (2) relative to the screw (1), the strap (3) itself can be used as a crank to screw or unscrew the screw (1) in or from the ice.

Although it is not essential, in the exemplary embodiment shown in the figures, in a section close to the clamp (2) the strap (3) has a coating (5), for example made of a thermoplastic material, forming a gripping area and/or transmission area of a torque to the clamp (2) and to the screw (1), when said clamp (2) is locked without possibility of rotation or longitudinal movement with respect to the screw.

It should be noted that the first end (31) of the strap (1) is fitted on the stem (22) of the clamp (2) with the possibility of free rotation, allowing it to be arranged parallel to the screw (1), as shown in FIGS. 5, 7 and 8, or substantially perpendicular to the axis of the screw (1), for example, during its use as a crank, as shown in the rest of the figures.

In the embodiment variant shown in FIGS. 7 and 8, the threaded leading section (12) covers the entire length of the screw (1), said screw (1) lacking the cylindrical smooth rear section (13) of the previous figures.

In the examples shown, the anchor further comprises a plug (6) fixed to the strap (3) and suitable for covering the teeth (11) defined at the leading end of the screw (1), in an inoperative or transport position of the anchor.

Once the nature of the invention as well as an example of preferred embodiment have been sufficiently described, it is stated for all pertinent purposes that the equipment, form, size and arrangement of the elements described are susceptible to changes, provided these do not involve an alteration of the essential features of the invention which are claimed below.

The invention claimed is:

1. An anchor for ice climbing, comprising: —a screw with a cylindrical tubular body and having, at its leading end, ice cutting and penetrating teeth, and at its external surface at least one threaded leading section, and at its rear end a stop perimeter projection, characterised in that it comprises:

a clamp arranged externally with respect to the screw and comprising an actuating part movable between: a locking position in which the clamp is tightened and fixed, without possibility of rotation or movement, at any point along the screw; and an unlocking position allowing for the clamp rotation with respect to the screw and the clamp positioning at any point along said screw;

a folded strap, attached by a first end to the clamp and having at its second end a closed loop for fitting a carabiner suited for the hitching of the climbing rope in a position of use of the anchor, or for the hitching of the anchor to a climber's harness in an inoperative position.

2. The anchor according to claim 1, characterised in that the strap has, on a section of its length, close to the clamp, a coating forming a grip and/or transmission area of a torque to the clamp and to the screw, when said clamp is locked, without possibility of rotation or longitudinal movement with respect to the screw.

3. The anchor according to claim 1, characterised in that the clamp has an internal thread complementary to the thread of the threaded leading section of the screw; said threads having an adequate height to allow their contact both in the locking position, and in the unlocking position, of the clamp.

4. The anchor according to claim 1, characterised in that the first end of the strap is attached to the clamp with the possibility of rotation with respect to an axis perpendicular to a plane coinciding with a longitudinal axis of the screw body.

5. The anchor according to claim 1, characterised in that the screw has, on its external surface, a cylindrical, smooth, rear section, which outer diameter coincides with the inner diameter of the thread of the threaded leading section.

6. The anchor according to claim 1, characterised in that the external surface of the screw body is threaded along its entire length.

7. The anchor, according to claim 1, characterised in that it comprises a plug fixed to the strap and suitable for covering the leading end of the screw, having the teeth, in an inoperative or transport position of the anchor.

8. The anchor, according to claim 1, characterised in that the actuating part is linked to a stem which is responsible for approaching the opposite ends of the clamp, causing the clamp to lock on the screw when the actuating part is placed in the locking position.

* * * * *